US011605483B2

(12) United States Patent
Wada et al.

(10) Patent No.: US 11,605,483 B2
(45) Date of Patent: Mar. 14, 2023

(54) COMPOSITE MAGNETIC BODY AND ELECTRONIC COMPONENT

(71) Applicant: TDK CORPORATION, Tokyo (JP)

(72) Inventors: Ryuichi Wada, Tokyo (JP); Takashi Suzuki, Tokyo (JP); Yusuke Nagai, Tokyo (JP); Kaori Sasaki, Tokyo (JP); Tatsuro Suzuki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/408,155

(22) Filed: Aug. 20, 2021

(65) Prior Publication Data

US 2022/0059264 A1 Feb. 24, 2022

(30) Foreign Application Priority Data

Aug. 24, 2020 (JP) ..... JP2020-140942

(51) Int. Cl.
*H01F 1/22* (2006.01)

(52) U.S. Cl.
CPC ..... *H01F 1/22* (2013.01)

(58) Field of Classification Search
None
See application file for complete search history.

(56) References Cited

U.S. PATENT DOCUMENTS 2,720,453 A * 10/1955 Altmann ..... B22F 9/00 75/359
2013/0286703 A1* 10/2013 Inaba ..... H01F 1/26 336/221
2017/0140864 A1 5/2017 Arai et al.
2018/0114627 A1 4/2018 Arai et al.
2018/0358164 A1 12/2018 Arai et al.

FOREIGN PATENT DOCUMENTS

JP 2017-092431 A 5/2017

* cited by examiner

*Primary Examiner* — Alexandre F Ferre
(74) *Attorney, Agent, or Firm* — Oliff PLC

(57) ABSTRACT

A composite magnetic body includes soft magnetic metal particles and non-magnetic ceramic particles each having a particle size (D50) smaller than that of the soft magnetic metal particles.

6 Claims, 6 Drawing Sheets

COMPOSITE MAGNETIC BODY AND ELECTRONIC COMPONENT

BACKGROUND OF THE INVENTION

The present invention relates to a composite magnetic body composed of soft magnetic metal particles and an electronic component including the composite magnetic body.

Compared to ferrites, metal magnetic bodies have a higher saturation magnetic flux density and a better DC bias characteristic. Thus, the metal magnetic bodies have been recently used instead of ferrites in electronic components such as inductors, transformers, and choke coils. For example, Patent Document 1 proposes a multilayer inductor using a FeCrSi alloy as a magnetic material.

Compared to ferrites, which are oxides, however, conventional metal magnetic bodies have a worse frequency characteristic of impedance and are not suitable for electronic components for high frequency applications.

Patent Document 1: JP2017092431 (A)

BRIEF SUMMARY OF INVENTION

The present invention has been achieved under such circumstances. It is an object of the invention to provide a composite magnetic body having a good DC bias characteristic and a good frequency characteristic of impedance and an electronic component including the composite magnetic body.

To achieve the above object, a composite magnetic body according to the present invention comprises:

soft magnetic metal particles; and non-magnetic ceramic particles each having a particle size (D50) smaller than that of the soft magnetic metal particles.

Since the composite magnetic body according to the present invention has the above-mentioned structure, a good DC bias characteristic is obtained, and a frequency characteristic of impedance is improved. Here, "a frequency characteristic of impedance is improved" means that a self-resonant frequency (SRF) of the composite magnetic body shifts to a higher frequency side. The self-resonant frequency (SRF) is a frequency at which the impedance reaches a maximum value in the frequency characteristic of impedance.

Soft ferrites such as Mn—Zn based ferrites and Ni—Zn based ferrites are ceramic, but magnetic material. Such soft ferrites do not correspond to the non-magnetic ceramic particles of the present invention.

Preferably, the non-magnetic ceramic particles are a silicate compound containing one or more elements selected from copper, zinc, nickel, aluminum, magnesium, and tin.

Preferably, the non-magnetic ceramic particles comprise a silicate compound represented by a formula of $\alpha(\beta ZnO.(1-\beta)CuO).SiO_2$, where $\alpha$ is 1.5 to 2.4, and $\beta$ is 0.60 to 1.00.

When the above-mentioned silicate compound is used as the non-magnetic ceramic particles, an interfacial reaction phase that impairs the characteristics of the magnetic body can be prevented from occurring between the soft magnetic metal particles and the ceramic particles.

Preferably, an amount of the non-magnetic ceramic particles is 0.6 parts by weight or more and 90 parts by weight or less with respect to 100 parts by weight of the soft magnetic metal particles. According to experiments by the present inventors or so, the larger the amount of the non-magnetic ceramic particles is, the higher frequency side the self-resonant frequency shifts to, and the better the frequency characteristic of impedance becomes. When the amount of the non-magnetic particles exceeds 90 parts by weight, the frequency characteristic of impedance is improved, but the formability of the magnetic body tends to deteriorate. Thus, the amount of the non-magnetic particles is preferably 90 parts by weight or less with respect to 100 parts by weight of the soft magnetic metal particles.

Preferably, the non-magnetic ceramic particles have a circularity of less than 0.98. According to experiments by the present inventors or so, the DC bias characteristic and the frequency characteristic of impedance tend to be further improved as the circularity of the non-magnetic particles becomes lower. When non-magnetic particles whose circularity is less than a predetermined value are used, a magnetic core composed of the composite magnetic body of the present invention is strengthened.

Preferably, the non-magnetic ceramic particles have a relative permittivity of 10 or less. When such non-magnetic ceramic particles are used, the frequency characteristic of impedance is further improved.

The composite magnetic body according to the present invention is applicable to various electronic components, such as an inductor, a transformer, a reactor, a choke coil, a composite element (e.g., an LC composite component with a coil region and a capacitor region), a noise filter, a magnetic sensor, and an antenna. In the present invention, an electronic component to which the composite magnetic body is applied can have the following structure.

That is, an electronic component according to the present invention comprises the above-mentioned composite magnetic body, wherein the non-magnetic ceramic particles exist among the soft magnetic metal particles in a cross section of the composite magnetic body. The electronic component having such a structure is excellent in DC bias characteristic and has a good frequency characteristic of impedance. Thus, the electronic component according to the present invention can advantageously be utilized as an electronic component for high frequency applications.

Preferably, $A_C/A_M$ is 0.07 to 19.3, where $A_M$ is an area occupied by the soft magnetic metal particles, and $A_C$ is an area other than the area occupied by the soft magnetic metal particles, in the cross section of the composite magnetic body.

In the above, the area $A_C$ includes an area occupied by the non-magnetic ceramic particles. When the area ratio $A_C/A_M$ is in the above-mentioned range, the DC bias characteristic and the frequency characteristic of impedance are further improved.

DETAILED DESCRIPTION OF INVENTION

Hereinafter, the present invention is explained based on an embodiment shown in the figures. In the present embodiment, a multilayer inductor is explained as an example of electronic components of the present invention.

Figure 1:
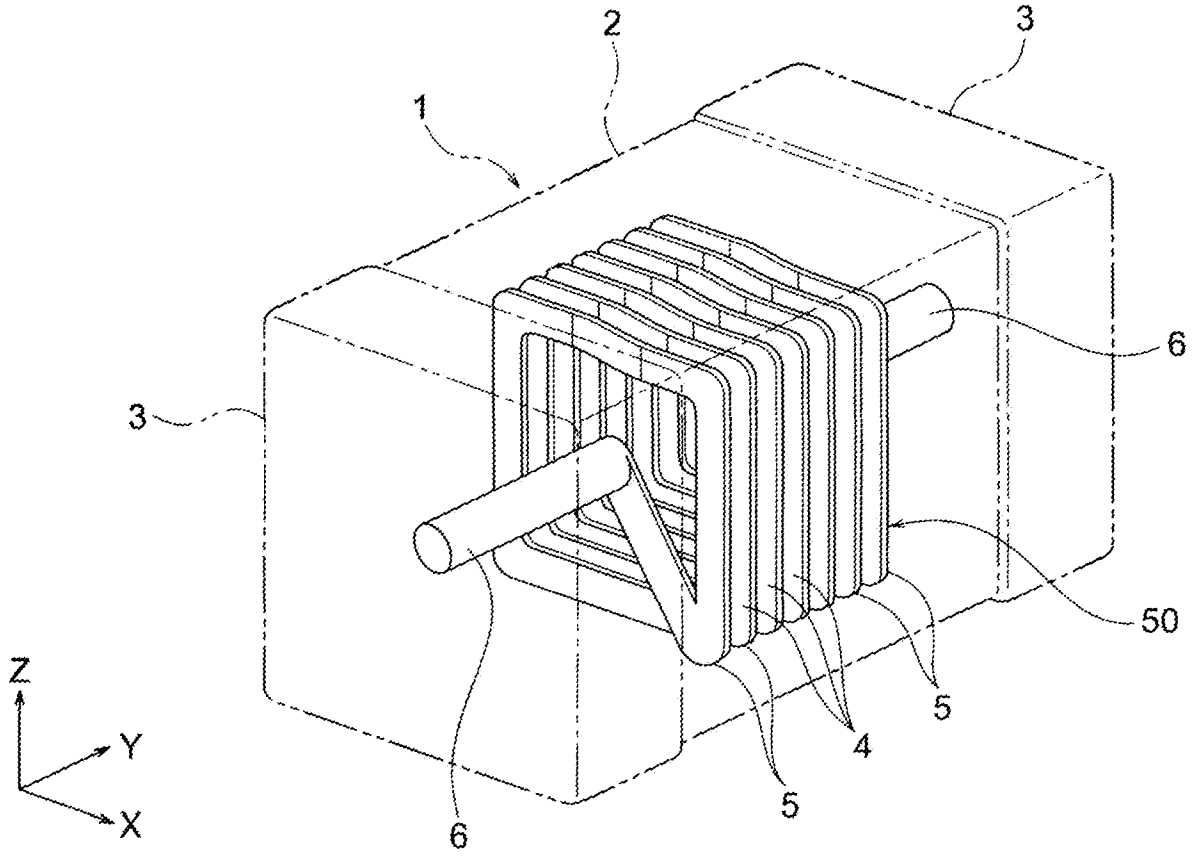
FIG. 1 is an internally transparent perspective view of an electronic component according to an embodiment of the present invention.

As shown in FIG. 1, a multilayer inductor 1 according to the present embodiment includes an element body 2 and terminal electrodes 3. The element body 2 consists of magnetic layers 4 and a coil conductor 50 with a three-dimensional and spiral form. The coil conductor 50 is embedded in the element body 2. A pair of terminal electrodes 3 is formed at both ends of the element body 2 and is electrically connected with the coil conductor 50 via led-out electrodes 6.

The element body 2 has any shape, but normally has a rectangular parallelepiped shape. The element body 2 also has any size appropriately determined based on usage. The material and thickness of the pair of terminal electrodes 3 are not limited as long as they are conductive. For example, the terminal electrodes 3 can be baked electrodes of conductive paste, conductive resin electrodes containing thermosetting resin or so, multilayer electrodes with plating on the external surface of the baked electrodes or the conductive resin electrodes, or the like.

The coil conductor 50 contained in the element body 2 has a spiral coil shape. This coil shape is formed by laminating internal electrode layers 5 with a predetermined pattern, such as square ring and square semi-circle, in the Y-axis direction via the magnetic layers 4 and connecting the internal electrode layers 5 next to each other by a through-hole electrode (not shown), a step electrode, or the like. Then, the led-out electrodes 6 are connected with both ends of the coil conductor 50 in the Y-axis direction. The led-out electrodes 6 are through-hole electrodes going through the magnetic layers 4. The coil conductor 50 and the led-out electrodes 6 are also made of any conductive material. For example, the coil conductor 50 and the led-out electrodes 6 can be made with a main component of Ag (silver), Cu (copper), Au (gold), Al (aluminum), Ag alloy, Cu alloy, etc. and may additionally contain glass frit, sub components, and unavoidable impurities.

In the present embodiment, the lamination direction of the magnetic layers 4 and the internal electrode layers 5 corresponds with the Y-axis, and the end surfaces of the terminal electrodes 3 are parallel to the X-axis and the Z-axis. The winding axis of the coil conductor 50 corresponds with the Y-axis. The X-axis, the Y-axis, and the Z-axis are perpendicular to each other.

Figure 2:
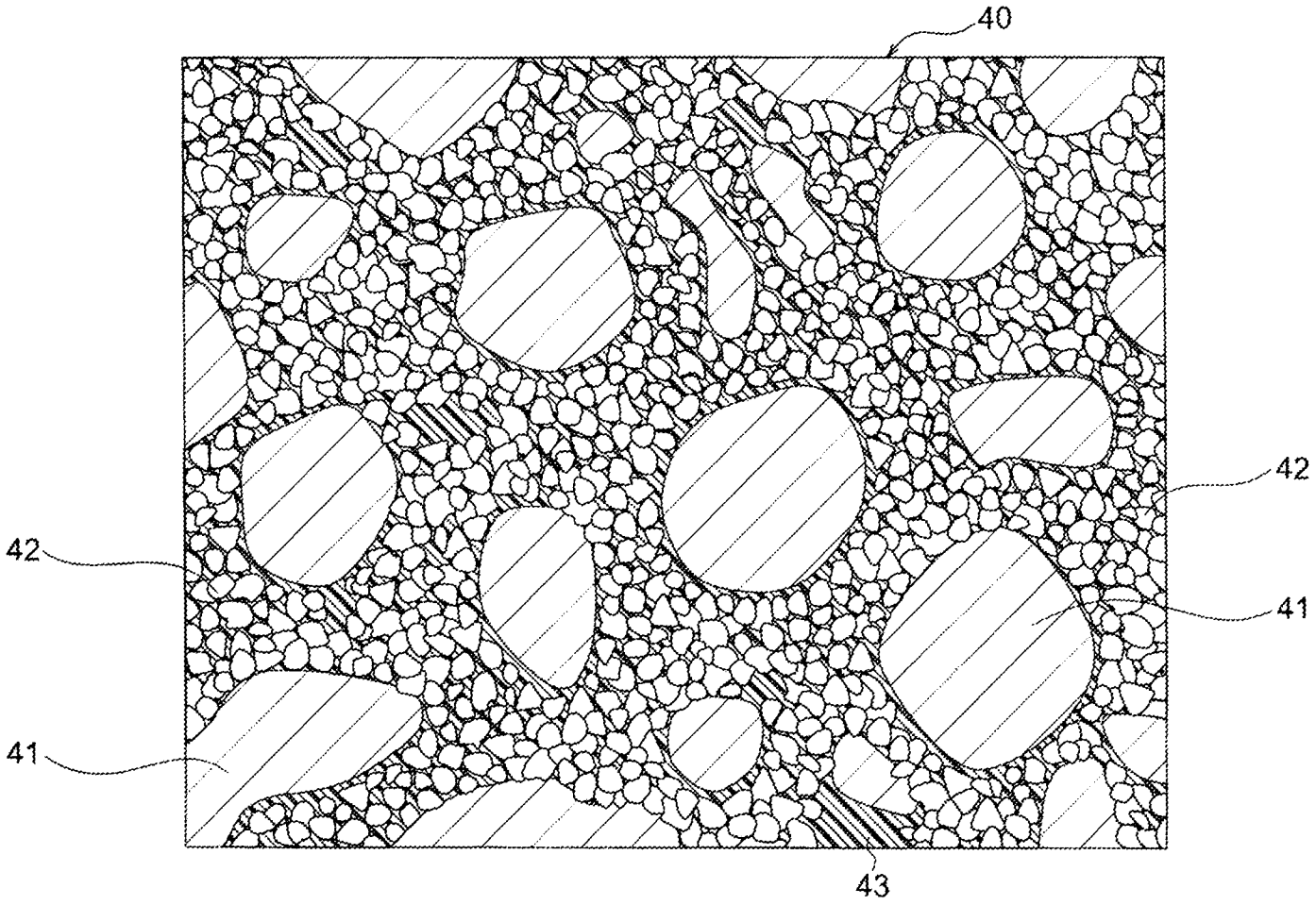
FIG. 2 is a schematic cross-sectional view of a composite magnetic body included in the electronic component shown in FIG. 1.

The magnetic layers 4 of the element body 2 include a composite magnetic body 40 according to the present embodiment. As shown in FIG. 2, the composite magnetic body 40 includes soft magnetic metal particles 41 and ceramic particles 42. Hereinafter, the composite magnetic body 40 according to the present embodiment is described in detail.

In the present embodiment, the soft magnetic metal particles 41 have any composition as long as they are made of a material exhibiting soft magnetism. The material exhibiting soft magnetism includes pure iron, Fe—Si based alloy (iron-silicon), Fe—Al based alloy (iron-aluminum), Fe—Ni based alloy (iron-nickel), sendust based alloy (Fe—Si—Al), Fe—Si—Cr based alloy (iron-silicon-chromium), Fe—Si—Al—Ni based alloy, Fe—Ni—Si—Co based alloy, Fe—Ni—Si—Co—Cr based alloy, Fe based amorphous alloy, Fe based nanocrystalline alloy, or the like. The soft magnetic metal particles 41 may contain P.

All of the soft magnetic metal particles 41 may be composed of the same material, or the soft magnetic metal particles 41 may be formed by mixing particles composed of different materials. For example, a part of the soft magnetic metal particles 41 may be composed of pure iron particles, and another part may be composed of a Fe—Si based alloy or so. "Different materials" means a case where elements constituting the metal particles are different, a case where constituent elements are the same but their composition ratios are different, a case where crystal systems are different, or the like.

An insulating film may be formed on the surfaces of the soft magnetic metal particles 41 (not shown). Examples of the insulating film include a resin film, an inorganic insulating film, and a film obtained by combining these, and the insulating film is preferably an inorganic insulating film. Examples of the inorganic insulating film include an oxidation film formed by oxidizing the particle surfaces by a heat treatment or so, a phosphate film, a film containing Si and formed by a silane coupling treatment, and various glass coatings, such as borosilicate glass. The insulating film may be formed on all particles or only some particles. The insulating coating has any thickness and can have a thickness of, for example, 5-60 nm. When the insulating film is formed, the insulating property between the metal particles can be enhanced, and the withstand voltage of the multilayer inductor 1 can be improved.

The soft magnetic metal particles 41 preferably have a median diameter (D50) of 1 μm or more and 15 μm or less and more preferably have a median diameter (D50) of 1 μm or more and less than 5.0 μm. A particle size of the soft magnetic metal particles 41 can be measured by observing a cross section of the element body 2 (a cross section of the magnetic layers 4) as shown in FIG. 2 with a scanning electron microscope (SEM), a scanning transmission electron microscope (STEM), or the like and performing an image analysis of the obtained cross-sectional photographs. In this measurement, the cross-sectional photographs are taken in at least five visual fields. Then, a circle equivalent diameter of the constituent particles (metal particles 41) contained in each of the cross-sectional photographs is measured to obtain a particle size distribution of the soft magnetic metal particles 41.

The soft magnetic metal particles 41 may be formed by mixing two or more particle groups having different average particle sizes. In that case, two or more peaks appear in the particle size distribution of the soft magnetic metal particles 41 according to the number of mixed particle groups. The shape of the soft magnetic metal particles 41 is not limited and may be, for example, spherical, elliptical spherical, needle-shaped, scaly, or indefinite.

On the other hand, the ceramic particles 42 are made of a non-magnetic ceramic having a smaller particle size than that of the soft magnetic metal particles 41.

Specifically, the ceramic particles 42 can have a median diameter (D50) of 0.01 μm or more and 3.0 μm or less, preferably 0.05-2.0 μm, more preferably 0.1-0.7 μm. A ratio ($d_C/d_M$) of a median diameter $d_C$ of the ceramic particles 42 to a median diameter $d_M$ of the soft magnetic metal particles 41 can be 0.003-0.8, preferably 0.01-0.67, more preferably 0.03-0.25. As in the case of the soft magnetic metal particles 41, a particle size of the ceramic particles 42 can be measured by an image analysis of cross-sectional photographs.

Examples of the main component of the ceramic particles 42 having the above-mentioned characteristics include a silicate compound, a titanate compound, a stannate compound, and a germanate compound. Soft ferrites such as Mn—Zn based ferrites and Mn—Ni based ferrites are a type of ceramic, but are magnetic materials. Thus, soft ferrites do not correspond to the ceramic particles 42 of the present embodiment. The ceramic particles 42 are not magnetic materials such as ferrites, but are non-magnetic materials.

The titanate compound exemplified above is also a type of non-magnetic ceramic. The titanate compound includes an oxide having a perovskite structure with a high relative permittivity, such as barium titanate and calcium titanate. However, the ceramic particles 42 of the present embodiment are preferably a compound having a relative permittivity of 10 or less rather than a compound having a high relative permittivity. When the ceramic particles 42 have a low relative permittivity, the relative permittivity of the composite magnetic body 40 can be reduced.

More specifically, the ceramic particles 42 are preferably a silicate compound containing one or more elements selected from copper (Cu), zinc (Zn), nickel (Ni), aluminum (Al), magnesium (Mg), and tin (Sn). Among these silicate compounds, it is particularly preferable to use a silicate compound represented by a formula of $\alpha(\beta ZnO.(1-\beta)CuO).SiO_2$. In this formula, $\alpha$ is preferably 1.5-2.4, and $\beta$ is preferably 0.60-1.00, more preferably 0.80-1.00.

When the ceramic particles 42 are made of the above-mentioned silicate compound, an interfacial reaction phase that inhibits the characteristics of the composite magnetic body 40 can be prevented from occurring between the soft magnetic metal particles 41 and the ceramic particles 42. For example, when the ceramic particles 42 are composed of only nickel oxide (NiO), a ferrite containing Ni may be generated between the soft magnetic metal particles 41 and the ceramic particles 42. On the other hand, when the ceramic particles 42 are the above-mentioned silicate compound, the interfacial reaction phase such as ferrite is not generated, and the DC bias characteristic is more favorable than when the ceramic particles 42 are composed of only nickel oxide.

Figure 3A:
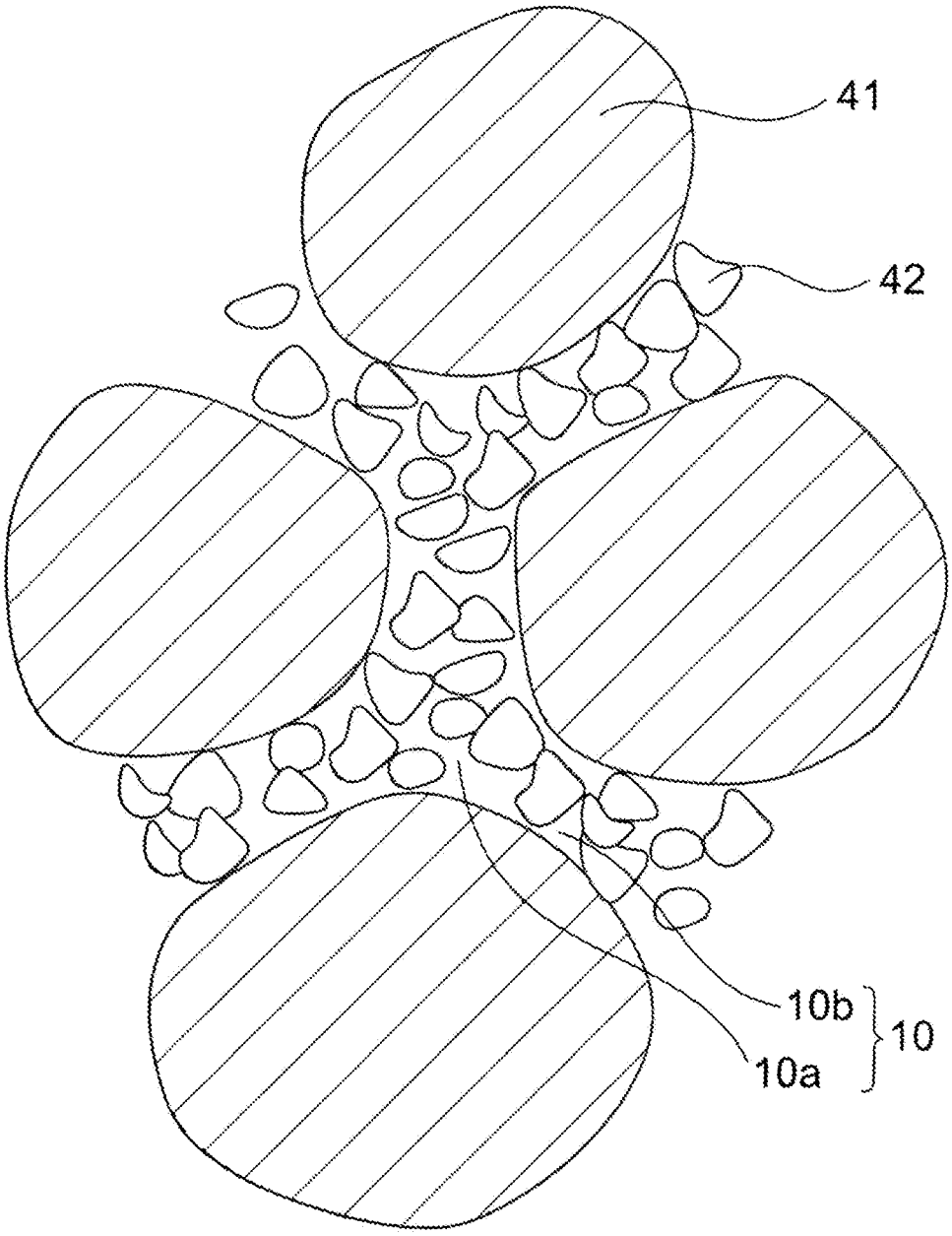
FIG. 3A is an enlarged schematic view of a main part of the composite magnetic body.

In a cross section of the composite magnetic body 40 according to the present embodiment (i.e., a cross section of the magnetic layers 4 constituting the element body 2), the ceramic particles 42 exist in grain boundaries 10 among the soft magnetic metal particles 41 and are filled in the grain boundaries 10. In particular, as shown in FIG. 3A, it is preferred that the ceramic particles 42 exist not only at grain-boundary triple points 10*a* (three soft magnetic metal particles 41 gather at one point), but also in grain boundaries 10*b* other than the triple points. In order to achieve the above-mentioned existence form of the ceramic particles in the cross section of the composite magnetic body 40, the amount of the ceramic particles 42 and/or the circularity of the ceramic particles 42 are/is preferably controlled within a predetermined range.

Specifically, the amount of the ceramic particles 42 in the composite magnetic body 40 is preferably 0.6 parts by weight or more and 90 parts by weight or less, more preferably 1 part by weight or more and 70 parts by weight or less, still more preferably 2 parts by weight or more and 60 parts by weight or less, with respect to 100 parts by weight of the soft magnetic metal particles.

Preferably, the ceramic particles 42 have a circularity of less than 0.98. Preferably, the ceramic particles 42 have a shape with a low circularity. The lower limit of the circularity can be 0.50 or more. The ceramic particles 42 more preferably have a circularity of 0.55-0.85 and still more preferably have a circularity of 0.55-0.70.

Figure 3B:
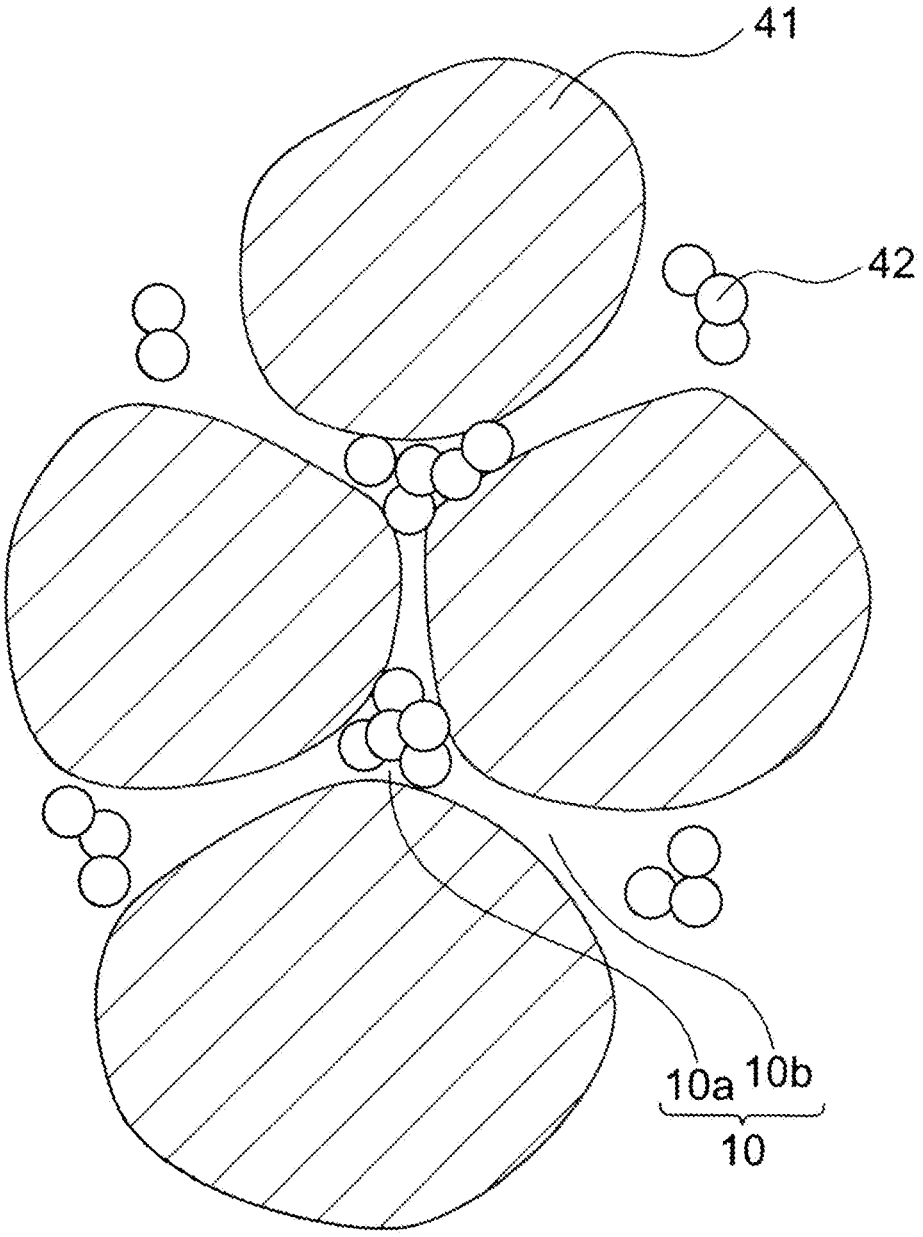
FIG. 3B is an enlarged schematic view of a main part of the composite magnetic body.

FIG. 3A and FIG. 3B are schematic views for explaining the influence of the amount of the ceramic particles 42 and the influence of the circularity of the ceramic particles 42 in the composite magnetic body 40. As shown in FIG. 3B, when the amount of the ceramic particles 42 is low or the circularity of the ceramic particles 42 is high, the ceramic particles 42 tend to gather at the grain boundary triple points 10*a* and aggregate at the grain boundary triple points 10*a*. On the other hand, as shown in FIG. 3A, when the amount of the ceramic particles 42 and/or the circularity of the ceramic particles 42 are/is controlled within the above-mentioned predetermined range, the ceramic particles 42 are filled not only in the grain boundary triple points 10*a* but also in the grain boundaries 10*b* other than the triple points, and the grain boundaries 10 of the soft magnetic metal particles 41 tend to spread.

The spread of the grain boundaries 10 of the soft magnetic metal particles 41 is synonymous with the increase of the interparticle distance of the soft magnetic metal particles 41. As the interparticle distance of the soft magnetic metal particles 41 increases, the relative permittivity of the composite magnetic body 40 tends to decrease, and a higher impedance is obtained even in a high frequency band of 1 GHz or more. When the ceramic particles 42 having a low circularity are used, the element body 2 composed of the composite magnetic body 40 is strengthened. It is considered that the reason why the element body 2 is strengthened is that an anchor effect is obtained by more densely filling the ceramic particles 42 in the grain boundaries 10 of the soft magnetic metal particles 41.

Both of the amount of the ceramic particles 42 and the circularity of the ceramic particles 42 can be measured by carrying out an image analysis of a cross section of the composite magnetic body 40 (a cross section of the magnetic layers 4 constituting the element body 2 in the present embodiment).

For example, when a cross section of the composite magnetic body 40 is observed with a backscattered electron image of SEM or a HAADF image of STEM, the soft magnetic metal particles 41 can be recognized as regions having a bright contrast, and the ceramic particles 42 can be recognized as regions having a darker contrast than that of the soft magnetic metal particles 41 and containing dense small particles. In the image analysis, an area $A_M$ occupied by the soft magnetic metal particles 41 in an observation cross section and an area $A_C$ other than the area occupied by the soft magnetic metal particles 41 in the observation cross section are obtained based on the contrast lightness and darkness (i.e., an area A of the observation region=$A_M+A_C$). The area $A_C$ includes an area of the ceramic particles 42 and may include other areas of voids and a binder. The content rate of the ceramic particles 42 can be estimated by converting the areas $A_M$ and $A_C$ into a weight rate.

When the proportion of the ceramic particles 42 in the composite magnetic body 40 is represented in terms of area proportion, a ratio ($A_C/A_M$) of the area $A_C$ to the area $A_M$ is preferably 0.07-19.3, more preferably 0.09-6.5, still more preferably 0.094-3.7. The amount and area ratio ($A_C/A_M$) of the ceramic particles 42 are preferably calculated as an average value obtained by performing the above-mentioned image analysis on cross sections of at least three visual fields or more. In the measurement of the areas $A_M$ and $A_C$, the magnification is appropriately adjusted according to the particle size of the soft magnetic metal particles 41. For example, each of the observation visual fields is 10-100 μm square.

In the measurement of the circularity of the ceramic particles 42, cross-sectional photographs are taken in five or more visual fields by setting an observation magnification of SEM or STEM to about 10,000-50,000 times and setting each observation visual field to a range corresponding to 1-100 μm square. Then, the circularity of each of the ceramic particle 42 included in the photographed cross-sectional photographs is measured by image analysis to calculate an average value.

As sub components, the ceramic particles 42 may contain bismuth oxide, boron oxide, glass component, and the like. A cover layer, such as a glass coating and an oxide film, may be formed on the surfaces of the ceramic particles 42. When the cover layer is formed on the ceramic particles 42, it is expected to exhibit a preventive effect on a chemical reaction between the soft magnetic metal particles 41 and the ceramic particles 42 and improvement effects on an insulating property between the metal particles and on a sintering density of the composite magnetic body 40. When the cover layer is formed on the surfaces of the ceramic particles 42, however, the number of man-hours in the manufacturing process increases, and the productivity decreases. In the present embodiment, the prevention of interfacial reaction phases and the improvement in insulating property and density can sufficiently be obtained by setting the material, amount, circularity, and the like of the ceramic particles 42 to the above-mentioned favorable modes even without forming the cover layer on the surfaces of the ceramic particles 42. In the composite magnetic body 40 of the present embodiment, it is not thereby always necessary to form the cover layer on the surfaces of the ceramic particles 42.

In addition to the soft magnetic metal particles 41 and the ceramic particles 42 mentioned above, the composite magnetic body 40 according to the present embodiment may contain a binder 43. The type of the binder 43 is not limited, but is preferably a resin. Specifically, examples of the resin include an epoxy resin, a phenol resin, an acrylic resin, a polyimide, a polyamide-imide, a silicone resin, and a composite resin obtained by mixing the above-mentioned resins. Preferably, the amount of the binder 43 is about 1-2 parts by weight with respect to 100 parts by weight of the soft magnetic metal particles 41. When the composite magnetic body 40 contains the binder 43, the insulating property between the soft magnetic metal particles 41 is further improved, and the element body 2 composed of the composite magnetic body 40 is strengthened.

Hereinafter, a method of manufacturing the composite magnetic body 40 and the multilayer inductor 1 according to the present embodiment is described, but the composite magnetic body 40 and the multilayer inductor 1 according to the present embodiment may be manufactured by any other methods.

First, a raw material powder of the soft magnetic metal particles 41 constituting the composite magnetic body 40 and a raw material powder of the ceramic particles 42 are prepared. The raw material powder of the soft magnetic metal particles 41 can be produced by a known powder production method, such as a gas atomizing method, a water atomizing method, a rotating disk method, and a carbonyl method. Alternatively, the raw material powder of the soft magnetic metal particles 41 may be produced by mechanically pulverizing a ribbon obtained by a single roll method. After obtaining the raw material powder of the soft magnetic metal particles 41 by the above-mentioned method, the particle size of the soft magnetic metal particles 41 can be adjusted by performing a sieve classification, an air flow classification, or the like. When an insulating film is formed on the surfaces of the soft magnetic metal particles 41, the raw material powders obtained above are appropriately subjected to a heat treatment, a phosphate treatment, a silane coupling treatment, or a cover-film formation treatment (e.g., hydrothermal synthesis).

Meanwhile, a ceramic powder produced by a known powder production method is also used as a raw material of the ceramic particles 42. For example, a raw material powder of a silicate compound represented by a formula of $\alpha$ ($\beta$ZnO.(1-$\beta$) CuO).$SiO_2$ is obtained after mixing powders of silicon oxide, zinc oxide, and copper oxide in a desired blending proportion and thereafter calcining this mixed powder. At this time, the particle size of the ceramic particles 42 can be adjusted by pulverizing the raw material powder and appropriately classifying it. The circularity of the ceramic particles 42 can be adjusted by controlling the type of the pulverizer used at the time of pulverization and the pulverization conditions and can also be adjusted by subjecting the pulverized particles to a plasma treatment.

Next, a method of manufacturing the multilayer inductor 1 by a sheet method using the above-mentioned raw material powders is described. First, the raw material powder of the soft magnetic metal particles 41 and the raw material powder of the ceramic particles 42 are kneaded together with additives, such as a solvent and the binder 43, and turned into slurry to obtain a magnetic paste. The solvent to be added at this time can be acetone, isopropyl alcohol (IPA), methyl ethyl ketone (MEK), butyl diglycol acetate (BCA), methanol, or the like. A dispersant may be added to the magnetic paste. The dispersant can be a silane coupling agent, oleic acid, oleylamine, or the like.

The magnetic paste is turned into sheet by a doctor blade method or so to obtain green sheets to be the magnetic layers 4 after firing. Next, a conductive paste is printed in a predetermined pattern on the green sheets to form internal electrode patterns to be the internal electrode layers 5 after firing. Then, the green sheets on which the internal electrode patterns are printed are laminated and appropriately pressurized, cut, or the like to obtain a green laminated body. At this time, the internal electrode patterns are joined by forming through-hole electrodes between the internal electrode patterns next to each other in the lamination direction in the process of laminating the green sheets or after the lamination. Since the through-hole electrodes are formed, a three-dimensional and spiral coil conductor pattern is integrally formed inside the green laminated body. The led-out electrodes 6 are also formed as the through-hole electrodes in the same manner as described above.

Next, the green laminated body obtained in the above-mentioned step is fired to obtain the element body 2. The firing conditions are not limited, and for example, the retaining temperature during firing can be 550-850° C., and the retaining time during firing can be 0.5-3.0 hours. Before the firing step, a binder removal treatment may appropriately be performed.

Then, the multilayer inductor 1 shown in FIG. 1 is obtained by forming a pair of terminal electrodes 3 on the element body 2 obtained in the above-mentioned step.

SUMMARY OF EMBODIMENT

In the multilayer inductor 1 of the present embodiment, the magnetic layers 4 corresponding to the magnetic core part of the element body 2 are composed of the composite magnetic body 40 including the soft magnetic metal particles 41 and the ceramic particles 42. The ceramic particles 42 contained in the composite magnetic body 40 are characterized in that they are a non-magnetic ceramic having a median diameter (D50) smaller than that of the soft magnetic metal particles 41. The composite magnetic body 40 and the multilayer inductor 1 of the present embodiment include the ceramic particles 42 having the above-mentioned characteristics and thereby have improved DC bias characteristic and frequency characteristic of impedance as compared with the conventional ones.

Figure 4:
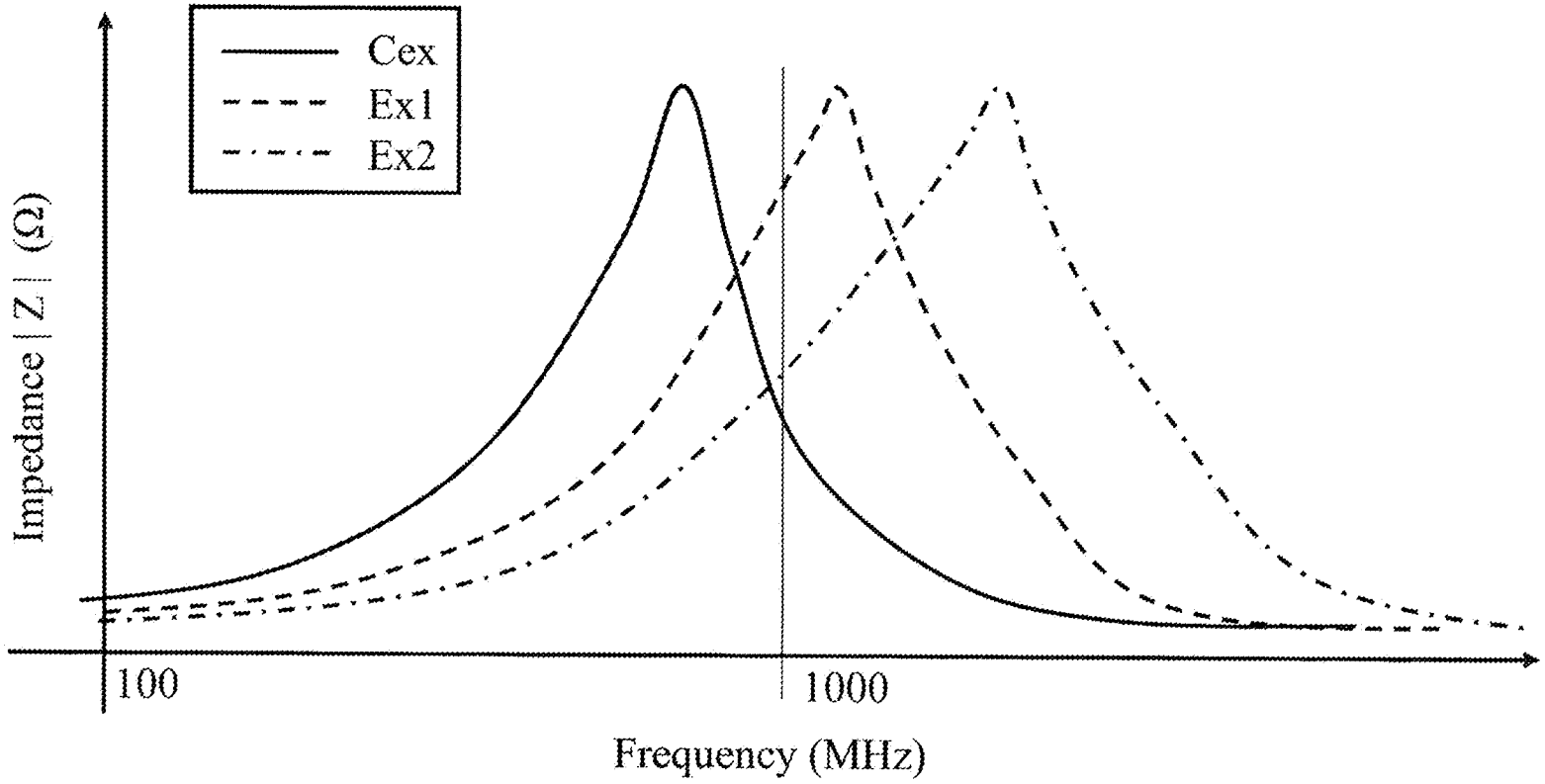
FIG. 4 is a graph schematically showing a measurement result of frequency characteristic of impedance.

FIG. 4 is a graph schematically showing the measurement results of the frequency characteristic of impedance (|Z|) with respect to the multilayer inductor. In FIG. 4, the graph Cex illustrated by the solid line is the result when the magnetic body is composed of only the soft magnetic metal particles 41 without adding the ceramic particles 42. On the other hand, the graph Ex1 illustrated by the broken line in FIG. 4 is the result when the ceramic particles 42 are added to the composite magnetic body 40. As shown in FIG. 4, when the ceramic particles 42 are added, the impedance peak (maximum value) shifts to the high frequency side. That is, the self-resonant frequency of the multilayer inductor 1 can be shifted to the high frequency side and set to 1 GHz or more by adding the ceramic particles 42 having predetermined characteristics to the composite magnetic body 40.

Figure 5:
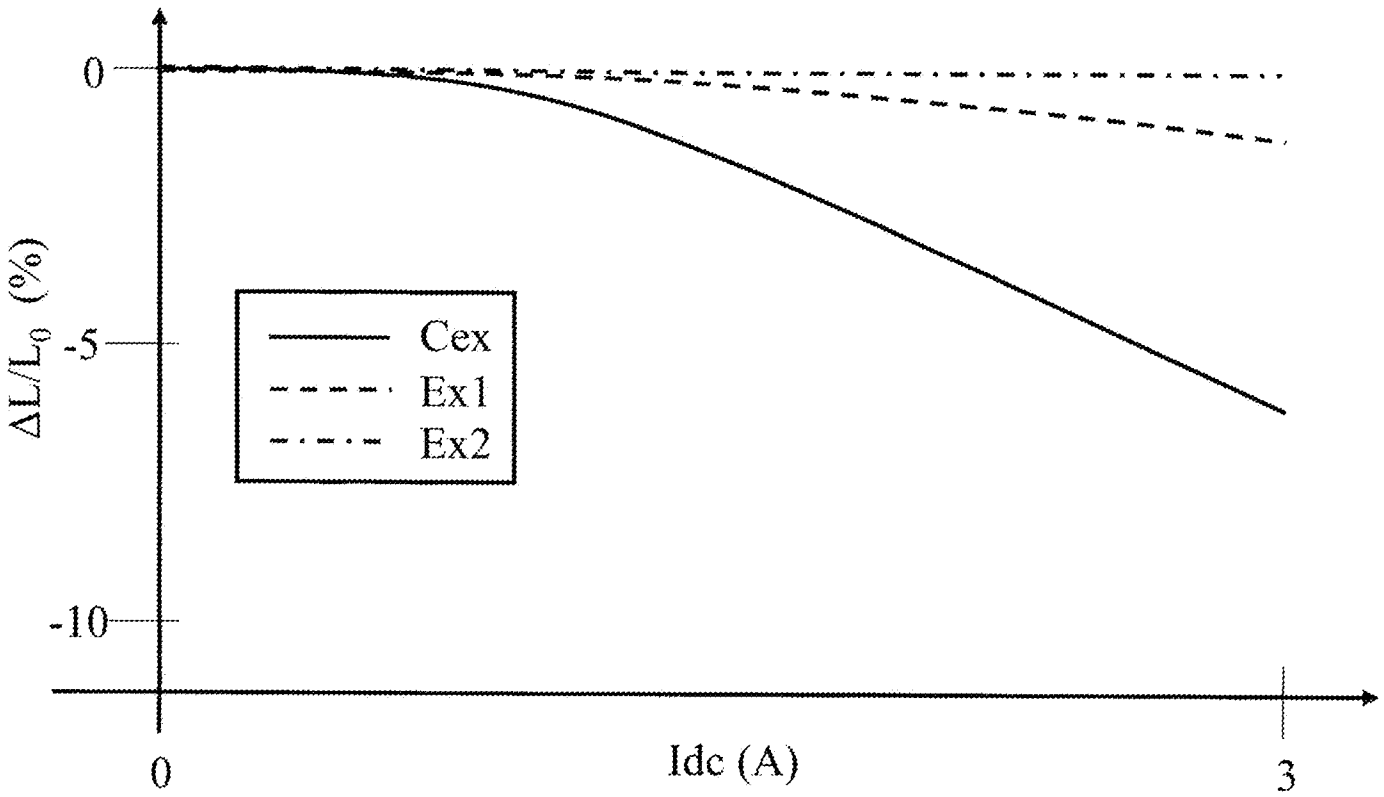
FIG. 5 is a graph schematically showing a measurement result of DC bias characteristic.

FIG. 5 is a graph schematically showing the evaluation results of the DC bias characteristic of the multilayer inductor. In the present embodiment, the DC bias characteristic is evaluated based on a change rate in inductance at the time of applying a direct current. Specifically, an inductance $L_0$ while no direct current is being applied and an inductance L while a direct current is being applied are measured, and their change rate is calculated as $(L-L_0)/L_0$ (%). It can be said that the smaller the change rate in inductance is, the better the DC superimposition characteristic is. As with FIG. 4, the solid-line graph Cex in FIG. 5 is the result when the magnetic body is composed of only the soft magnetic metal particles 41 without adding the ceramic particles 42, and the broken-line graph Ex1 in FIG. 5 is the result when the ceramic particles 42 are contained. As shown in FIG. 5, when the ceramic particles 42 having predetermined characteristics are added to the composite magnetic body 40, the change rate in inductance at the time of applying a direct current is reduced, and the DC bias characteristic is improved.

The reason why the DC bias characteristic and the frequency characteristic of impedance are improved is not necessarily clear. For example, the increase in the interparticle distance of the soft magnetic metal particles 41 by adding the ceramic particles 42 is considered to be the reason.

In the composite magnetic body 40 of the present embodiment, the amount of the ceramic particles 42 is 0.6 parts by weight or more and 90 parts by weight or less with respect to 100 parts by weight of the soft magnetic metal particles 41. When the amount of the ceramic particles 42 is increased, as shown in the graph Ex2 of FIG. 4, the self-resonant frequency shifts to a higher frequency side, and the frequency characteristic of impedance is further improved. As shown in the graph Ex2 of FIG. 5, the DC bias characteristic is also further improved. When the amount of the ceramic particles 42 exceeds 90 parts by weight, the frequency characteristic of impedance is improved, but the formability of the composite magnetic body 40 tends to deteriorate. Thus, the amount of the ceramic particles 42 is preferably 90 parts by weight or less with respect to the soft magnetic metal particles 41.

In the composite magnetic body 40 of the present embodiment, the ceramic particles 42 have a circularity of less than 0.98. Since the ceramic particles 42 have a low circularity, as shown in the graphs Ex2 of FIG. 4 and FIG. 5, the DC bias characteristic and the frequency characteristic of impedance tend to be further improved. As described above, since the ceramic particles 42 have a low circularity, an anchor effect is obtained, and the element body 2 composed of the composite magnetic body 40 is strengthened.

In the present embodiment, the ceramic particles 42 preferably have a relative permittivity of 10 or less. When the ceramic particles 42 having a low relative permittivity is used, the relative permittivity of the composite magnetic body 40 tends to also decrease, and the frequency characteristic of impedance is further improved.

More specifically, the ceramic particles 42 are preferably a silicate compound satisfying predetermined conditions. When the ceramic particles 42 are a silicate compound, an interfacial reaction phase that impairs the characteristics of the composite magnetic body 40 can be prevented from occurring between the soft magnetic metal particles 41 and the ceramic particles 42.

Hereinbefore, an embodiment of the present invention is described, but the present invention is not limited to the above-described embodiment and can variously be modified within the scope of the present invention.

For example, a multilayer inductor is described as an application example of the composite magnetic body 40 according to the present invention in the above-mentioned embodiment, but the inductor to which the present invention can be applied is not limited to the multilayer type. For example, an inductor element may be obtained by forming a magnetic core with pressure-molding of the composite magnetic body 40 and winding a conductive wire or plate around the magnetic core. Moreover, an inductor element may be obtained by compacting the composite magnetic body of the present invention together with an air-core coil. In such winding inductors, the magnetic core has any form and can be a green compact or a sintered body of toroidal type, FT type, ET type, EI type, UU type, EE type, EER type, UI type, drum type, pot type, cup type, or the like. The composite magnetic body 40 according to the present invention can also be applied to a magnetic core of a thin film inductor.

In the above-mentioned embodiment, the inductor is exemplified as the electronic component according to the present invention, but the electronic component according to the present invention may be any other electronic components, such as a transformer, a reactor, a choke coil, a composite element (e.g., an LC composite component with a coil region and a capacitor region), a noise filter, a magnetic sensor, an antenna, and a non-contact feeding device. That is, the composite magnetic body 40 of the present invention can be used as a magnetic core of various coil devices or a magnetic sheet of a filter, an antenna, a magnetic sensor, or the like. When the various electronic components as described above include the composite magnetic body 40 according to the present invention, the electronic components can also advantageously be used for high frequency applications.

EXAMPLES

Hereinafter, the present invention is explained based on further detailed examples, but is not limited to the examples.

Experiment 1

In Experiment 1, a magnetic body sample composed of only metal particles (Sample 1) and magnetic body samples composed of mixing metal particles and ceramic particles (Samples 4-13) were prepared, and the characteristics of each magnetic body sample was evaluated. In Experiment 1, the type of ceramic particles was changed in Samples 4-13. Hereinafter, the method of preparing the magnetic body samples is described.

First, a 94.0Fe-6.0Si alloy powder was prepared as a metal raw material powder of soft magnetic metal particles 41. This metal raw material powder was prepared by an atomizing method and then subjected to a heat treatment to form an oxide film having an average thickness of 20 nm on the surfaces of the metal particles.

Meanwhile, a ceramic raw material powder of the ceramic particles 42 was prepared by mixing predetermined oxide powders, calcining this mixture, and then pulverizing it. As described above, ceramic raw material powders made of different materials were prepared in Samples 4-13 of Experiment 1. Table 1 shows the composition and the relative permittivity of the ceramic particles 42 of each sample.

The relative permittivity of the ceramic particles 42 was measured by the capacitive method using an LCR meter (4285A). This measurement was carried out at a measurement frequency of 1 MHz and a room temperature of 25° C. Measurement samples for relative permittivity were obtained by pressure molding only the raw material powder of the ceramic particles 42 obtained in the above-mentioned step. The measurement samples had a disk shape (diameter: 10 mm, height: 5 mm).

Next, the prepared raw material powders of the soft magnetic metal particles 41 and the ceramic particles 42 were mixed to obtain magnetic body samples. In sample 1, however, the magnetic body sample was composed of only the soft magnetic metal particles 41 without adding the ceramic particles 42. In all of the magnetic body samples of Experiment 1, the particle size (D50) of the soft magnetic metal particles 41 was 3.0 In each of the magnetic body samples of Experiment 1, the particle size (D50) of the ceramic particles 42 was 0.3 and the amount of the ceramic particles 42 was 2.0 parts by weight with respect to 100 parts by weight of the soft magnetic metal particles.

(Measurement of Relative Permittivity of Magnetic Body Samples)

The relative permittivity of the magnetic body samples obtained in the above-mentioned step was measured in the same manner as the raw material powder of the ceramic particles 42. In the measurement of the relative permittivity of the magnetic body samples, a measurement sample was a molded body obtained by pressure-molding a mixed powder of the soft magnetic metal particles 41 and the ceramic particles 42 in a disk shape. Preferably, the magnetic body samples had a low relative permittivity, and a relative permittivity of 100 or less was considered to be good. Table 1 shows the measurement results of the relative permittivity of each magnetic body sample.

(Preparation of Multilayer Inductor Samples)

In Experiment 1, inductor samples were manufactured using the prepared magnetic body samples. Specifically, a butyral resin and a solvent were added to the above-mentioned magnetic body samples to obtain a magnetic body paste, and multilayer inductors shown in FIG. 1 were manufactured by a sheet method using the magnetic body paste. In the inductor samples, a coil conductor contained inside the element body 2 was composed of an Ag electrode.

(Measurement of Frequency Characteristic of Impedance)

As a characteristic evaluation of the inductor samples, the frequency characteristic of impedance was measured by an impedance analyzer (E4991A RF impedance/material analyzer). The measurement was performed at room temperature, and a self-resonant frequency (SRF) was calculated from a maximum value of impedance. If the SRF is 1000 MHz or more, the multilayer inductor can sufficiently be used for high frequency applications. Thus, a SRF of 1000 MHz or more was considered to be good. Table 1 shows the evaluation results of the frequency characteristic of each sample.

(Evaluation of DC Bias Characteristic)

A DC bias characteristic of the inductor samples was measured. The DC bias characteristic was evaluated based on a change rate in inductance at the time of applying a direct current to the inductor samples. In the present example, an inductance $L_0$ while a direct current (Idc) was not applied and an inductance $L_{1.5}$ while a direct current of 1.5 A was applied were measured using an LCR meter (4284A precision LCR meter). Then, a change rate in inductance ($\Delta L/L_0$: unit %) was calculated based on a formula of $(L_{1.5}-L_0)/L_0$. The DC superimposition characteristic was better as the change rate in inductance was smaller. In this experiment, a change rate in inductance of 0% was considered to be good. Table 1 shows the evaluation results of the frequency characteristic of each sample.

TABLE 1

| | Ceramic Particles | | Relative Permittivity | Characteristics of Inductor | |
|---|---|---|---|---|---|
| Sample No. | Main Component — | Relative Permittivity — | of Composite Magnetic Body — | Frequency Characteristic SRF(MHz) | DC bias characteristic $\Delta L/L_0$ (%) |
| 1 | — | — | 110 | 770 | −5 |
| 4 | $CaTiO_3$ | 150 | 130 | 850 | 0 |
| 5 | $ZnO \cdot Fe_2O_3$ | 15 | 89 | 900 | −2 |
| 6 | $2ZnO \cdot SiO_2$ | 4 | 70 | 1150 | 0 |
| 7 | $2(0.8ZnO \cdot 0.2CuO) \cdot SiO_2$ | 4 | 70 | 1200 | 0 |
| 8 | $2(0.6ZnO \cdot 0.4CuO) \cdot SiO_2$ | 4 | 69 | 1140 | 0 |
| 9 | $3Al_2O_3 \cdot 2SiO_2$ | 6.5 | 75 | 1030 | 0 |
| 10 | $2MgO \cdot 2Al_2O_3 \cdot 5SiO_2$ | 4 | 70 | 1060 | 0 |
| 11 | $3MgO \cdot SiO_2$ | 6 | 73 | 1080 | 0 |
| 12 | $2MgO \cdot SiO_2$ | 6.5 | 75 | 1020 | 0 |
| 13 | $2NiO \cdot SiO_2$ | 7 | 78 | 1000 | 0 |

Evaluation Results of Experiment 1

As shown in Table 1, Samples 4-13 (the ceramic particles were added) had a higher SRF and a lower change rate in inductance than that of Sample 1 (no ceramic particles were added). This result shows that when the non-magnetic ceramic particles each having a particle size smaller than that of the soft magnetic metal particles were added to the composite magnetic body, the DC bias characteristic was improved, and the frequency characteristic of impedance was improved. In Sample 5, $ZnO.Fe_2O_3$ was a type of ferrite, but was non-magnetic ceramic.

Comparing the results of Samples 4-13, characteristics of the inductor were particularly good in Samples 6-13 (the silicate compound was added). Specifically, Samples 6-13 had a SRF of 1000 MHz or more and a change rate in inductance of 0% and had further improved DC bias characteristic and frequency characteristic of impedance as compared with Samples 4 and 5. The silicate compounds of Samples 6-13 had a relative permittivity of 10 or less. This result shows that the relative permittivity of the ceramic particles added to the composite magnetic body was preferably 10 or less.

Among Samples 6-13 (the silicate compound was added), the evaluation results of Samples 6-8 were good. This result shows that it was particularly preferable to use a silicate compound represented by a formula of $\alpha(\beta ZnO.(1-\beta)CuO).SiO_2$ as the ceramic particles among silicate compounds.

Although not shown in Table 1, a composite magnetic body sample to which only NiO was added as ceramic particles was also prepared. In the sample to which only NiO was added, it was confirmed from the results of cross-sectional observation by SEM that a Ni ferrite was generated between the soft magnetic metal particles and the ceramic particles. On the other hand, interfacial reaction phases, such as Ni ferrite, were not observed in Samples 6-13 (the silicate compound was added). Samples 6-13 (the silicate compound was added) had a higher SRF and a better DC bias characteristic than that of the sample to which only NiO was added. These results show that when the silicate compound was used as the ceramic particles, it was possible to prevent the generation of interfacial reaction phases that inhibit characteristics of the magnetic body, and the DC bias characteristic and the frequency characteristic of impedance were further improved.

Experiment 2

In Experiment 2, a particle size (D50) of soft magnetic metal particles 41 and a particle size (D50) of ceramic particles 42 were changed, and magnetic body samples according to Samples 21-32 were prepared. Multilayer inductors shown in FIG. 1 were manufactured in the same manner as in Experiment 1 using the magnetic body samples, and inductor samples according to Samples 21-32 were obtained. Table 2 shows the particle size of the soft magnetic metal particles 41 and the particle size of the ceramic particles 42 in each sample of Experiment 2.

The particle size of each of the particles 41 and 42 shown in Table 2 was a median diameter calculated by observing a cross section of the prepared inductor sample by SEM and performing an image analysis. At this time, the cross-sectional observation was performed in five visual fields, and a particle size distribution of each of the particles 41 and 42 was obtained by measuring a circle equivalent diameter of each of the particles 41 and 42 contained in the observation visual fields. The particle size shown in the tables other than Table 2 was the same as above.

In each sample of Experiment 2, a 94.0Fe-6.0Si alloy was used as the soft magnetic metal particles 41, and a $2ZnO.SiO_2$ was used as the ceramic particles 42. In each sample of Experiment 2, the amount of the ceramic particles 42 was 2.0 parts by weight with respect to 100 parts by weight of the soft magnetic metal particles. The experimental conditions other than the above-mentioned ones in Experiment 2 were the same as those in Experiment 1. Table 2 shows the evaluation results of each sample in Experiment 2.

TABLE 2

| | Soft Magnetic Metal Particles | Ceramic Particles Median | Particle | Relative Permittivity of Composite | Characteristics of Inductor | |
|---|---|---|---|---|---|---|
| Sample No. | Median Diameter ($d_M$) μm | Diameter ($d_C$) μm | Size Ratio $d_C/d_M$ — | Magnetic Body — | Frequency Characteristic SRF(MHz) | DC bias characteristic $AL/L_0$ (%) |
| 1 | 3 | — | — | 110 | 770 | −5 |
| 21 | 3 | 0.01 | 0.003 | 107 | 800 | 0 |
| 22 | 3 | 0.05 | 0.017 | 80 | 1000 | 0 |
| 23 | 3 | 0.10 | 0.033 | 73 | 1090 | 0 |
| 24 | 3 | 0.30 | 0.100 | 70 | 1150 | 0 |
| 25 | 3 | 0.50 | 0.167 | 73 | 1080 | 0 |
| 26 | 3 | 0.70 | 0.233 | 78 | 1020 | 0 |
| 27 | 3 | 1.00 | 0.333 | 84 | 1000 | 0 |
| 28 | 3 | 2.00 | 0.667 | 86 | 1000 | 0 |
| 29 | 3 | 3.00 | 1.000 | 108 | 800 | −3 |
| 30 | 3 | 4.00 | 1.333 | 110 | 780 | −5 |
| 31 | 1 | 0.30 | 0.3 | 76 | 1350 | 0 |
| 32 | 7.5 | 0.30 | 0.04 | 75 | 1050 | 0 |

Evaluation Results of Experiment 2

As shown in Table 2, Samples 21-28 and 31-32 (the ceramic particles each having a particle size smaller than that of the soft magnetic metal particles were added) had a higher SRF and a lower change rate in inductance than that of Sample 1 (no ceramic particles were added). On the other hand, Sample 29 (particle size ratio $d_C/d_M$ was 1.0) and Sample 30 (the particle size of the ceramic particles was larger than that of the soft magnetic metal particles) hardly obtained an improvement effect on the DC bias characteristic and an improvement effect on the frequency characteristic of impedance. This result shows that the DC bias characteristic and the frequency characteristic of impedance were improved by adding the ceramic particles each having a particle size smaller than that of the soft magnetic metal particles to the composite magnetic body.

In Samples 22-28, the SRF was 1000 MHz or more, and the change rate in inductance was 0%. This result shows that the particle size (D50) of the ceramic particles was preferably 0.05-2.0 μm, more preferably 0.1-0.7 This result also shows that the particle size ratio $d_C/d_M$ was preferably 0.01-0.67, more preferably 0.03-0.25.

The results of Samples 31 and 32 show that even when the particle size of the soft magnetic metal particles was changed, an improvement effect on the DC bias characteristic and an improvement effect on the frequency characteristic of impedance could be obtained as in Samples 22-28. In addition, the SRF of Sample 31 was higher than that of Sample 32. These results show that the frequency characteristic of impedance can further be improved by adding the ceramic particles and reducing the particle size of the soft magnetic metal particles.

Experiment 3

In Experiment 3, in order to examine the influence of the amount of ceramic particles, magnetic body samples were prepared by changing the amount of the ceramic particles, and inductor samples according to Samples 41-58 were prepared. Table 3 shows the amount of the ceramic particles in each of Samples 41-58 of Experiment 3.

In Experiment 3, an area ratio between the soft magnetic metal particles and the ceramic particles and an inductance L were measured in addition to the DC bias characteristic and the frequency characteristic of impedance. The area ratio $A_C/A_M$ was calculated as an average value obtained by observing a cross section of the inductor sample in five visual fields. The inductance L was measured using an impedance analyzer to measure an inductance at a frequency of 100 MHz. Table 3 shows the evaluation results of each sample in Experiment 3.

Also in Experiment 3, a 94.0Fe-6.0Si alloy having a D50 of 3.0 μm was used as the soft magnetic metal particles, and $2ZnO.SiO_2$ having a D50 of 0.3 μm was used as the ceramic particles. Except for changing the amount of the ceramic particles, the experimental conditions in Experiment 3 were the same as those in Experiment 1.

TABLE 3

| | Soft Magnetic Metal | Ceramic Particles | | Evaluation Results of Inductor | | | |
|---|---|---|---|---|---|---|---|
| Sample No. | Particles D50 μm | D50 μm | Amount parts by weight | Area Ratio ($A_C/A_M$) — | Frequency Characteristic SRF(MHz) | DC bias characteristic $\Delta L/L_0$ (%) | Inductance L(nH) |
| 1 | 3 | — | 0 | — | 770 | −5 | 73 |
| 41 | 3 | 0.3 | 0.5 | 0.052 | 800 | −4 | 72 |
| 42 | 3 | 0.3 | 0.6 | 0.072 | 1000 | 0 | 68 |
| 43 | 3 | 0.3 | 0.8 | 0.086 | 1020 | 0 | 66 |
| 44 | 3 | 0.3 | 1.0 | 0.091 | 1050 | 0 | 64 |
| 45 | 3 | 0.3 | 2.0 | 0.094 | 1150 | 0 | 60 |
| 46 | 3 | 0.3 | 5.0 | 0.114 | 1350 | 0 | 56 |
| 47 | 3 | 0.3 | 8.0 | 0.284 | 1500 | 0 | 50 |
| 48 | 3 | 0.3 | 10.0 | 0.412 | 1650 | 0 | 45 |
| 49 | 3 | 0.3 | 15.0 | 0.564 | 2000 | 0 | 36 |
| 50 | 3 | 0.3 | 20.0 | 0.685 | 2250 | 0 | 26 |
| 51 | 3 | 0.3 | 30.0 | 0.974 | 2700 | 0 | 20 |
| 52 | 3 | 0.3 | 40.0 | 1.356 | 3000 | 0 | 14 |
| 53 | 3 | 0.3 | 50.0 | 2.362 | >3000 | 0 | 8 |
| 54 | 3 | 0.3 | 60.0 | 3.670 | >3000 | 0 | 6 |
| 55 | 3 | 0.3 | 70.0 | 6.434 | >3000 | 0 | 5 |
| 56 | 3 | 0.3 | 80.0 | 11.455 | >3000 | 0 | 3 |
| 57 | 3 | 0.3 | 90.0 | 19.257 | >3000 | 0 | 2 |
| 58 | 3 | 0.3 | 100.0 | — | — | — | 1 |

Evaluation Results of Experiment 3

As shown in Table 3, when the amount of the ceramic particles was 0.6 parts by weight or more with respect to 100 parts by weight of the soft magnetic metal particles or when the area ratio $A_C/A_M$ was 0.072 or more, the SRF was 1000 or more, and the DC bias characteristic and the frequency characteristic of impedance were improved. As the amount of the ceramic particles increased, the SRF shifted to the high frequency side, and the frequency characteristic of impedance was further improved. In Samples 53-57 (the amount of the ceramic particles was 50 parts by weight or more), the SRF was ">3000". The reason for this notation was that the measurable range of the impedance analyzer used in this experiment was up to 3000 MHz. The SRF of Samples 53-57 was considered to be higher as the amount of the ceramic particles increased.

In Sample 58 (the amount of the ceramic particles was 100 parts by weight), the DC bias characteristic and the frequency characteristic of impedance were considered to be improved, but the formability of the magnetic body sample was deteriorated due to the excessive amount of the ceramic particles, and the body shape could not be kept normal. Thus, considering the formability of the magnetic body, the upper limit of the amount of the ceramic particles was preferably 90 parts by weight or less, and the upper limit of the area ratio $A_C/A_M$ was preferably 19.257 or less.

Considering the measurement results of the inductance L shown in Table 3, the amount of the ceramic particles was more preferably 1 part by weight or more and 70 parts by weight or less, still more preferably 2 parts by weight or more and 60 parts by weight or less. The area ratio $A_C/A_M$ was more preferably 0.091-6.434, still more preferably 0.094-3.670. That is, when the amount of the ceramic particles was within the above-mentioned range, a good DC bias characteristic and a good frequency characteristic were obtained while securing the required inductance L.

Experiment 4

In Experiment 4, magnetic body samples were prepared by changing the circularity of ceramic particles, and inductor samples according to samples 61-67 were prepared. The circularity of the ceramic particles was controlled by adjusting the pulverization conditions after calcination (pulverization time in ball mill, ball diameter, etc.) and appropriately subjecting the pulverized particles to a plasma treatment in the preparation of the raw material powders. The circularity of the ceramic particles was calculated by observing a cross section of the inductor sample by SEM and performing an image analysis. Specifically, the magnification at the time of cross-sectional observation was 35,000 times, and a cross-sectional photograph of 10 $\mu m^2$ was taken for five visual fields. Then, the obtained cross-sectional photographs were subjected to an image analysis to measure the circularity of the ceramic particles contained in the cross-sectional photographs. Table 4 shows the circularity of the ceramic particles in each sample of Experiment 4. The circularity shown in Table 4 was an average value.

In Experiment 4, a cutting test was carried out so as to evaluate the strength of the prepared inductor samples. In the cutting test, element bodies of the inductor samples were cut using a dicer in a direction parallel to the lamination direction of the magnetic layers (Y-axis direction). Then, the cut cross sections were observed with the naked eyes and a stereomicroscope to confirm the presence or absence of cracks and chips. The cutting test was carried out for 1000 pieces of each sample, and a rate of non-defective products without cracks or chips was calculated.

Also in Experiment 4, a 94.0Fe-6.0Si alloy having a D50 of 3.0 μm was used as the soft magnetic metal particles, and $2ZnO.SiO_2$ having a D50 of 0.3 μm was used as the ceramic particles, and the amount of the ceramic particles was 2 parts by weight. The experimental conditions of Experiment 4 other than the above-mentioned ones were the same as those of Experiment 1. Table 4 shows the evaluation results of each sample in Experiment 4.

TABLE 4

| Sample No. | Ceramic Particles Circularity — | Relative Permittivity of Composite Magnetic Body — | Evaluation Results of Inductor: Frequency Characteristic SRF(MHz) | DC bias characteristic $\Delta L/L_0$ (%) | Cutting Test Nondefective Rate (%) |
|---|---|---|---|---|---|
| 1 | — | 110 | 770 | −5 | 100 |
| 61 | 0.98 | 106 | 980 | −3 | 57 |
| 62 | 0.85 | 84 | 1050 | 0 | 100 |
| 63 | 0.70 | 78 | 1150 | 0 | 100 |
| 64 | 0.62 | 75 | 1180 | 0 | 100 |
| 65 | 0.60 | 72 | 1170 | 0 | 100 |
| 66 | 0.55 | 74 | 1180 | 0 | 100 |
| 67 | 0.50 | 75 | 1040 | 0 | 43 |

Evaluation Results of Experiment 4

As shown in Table 4, the relative permittivity of the magnetic body samples was 100 or less, and the frequency characteristic of impedance was improved, in Samples 62-67 (the circularity of the ceramic particles was less than 0.98). In particular, the circularity of the ceramic particles was more preferably 0.55-0.85, still more preferably 0.55-0.70.

The results of Table 4 show that when the ceramic particles had a low circularity, the non-defective rate in the cutting test was increased, and the element bodies were strengthened. In Sample 67 (the circularity of the ceramic particles was 0.5), however, the non-defective rate in the cutting test was rather decreased. This result shows that the lower limit of the circularity of the ceramic particles was preferably 0.55 or more.

DESCRIPTION OF THE REFERENCE NUMERICAL

1 . . . multilayer inductor
2 . . . element body
4 . . . magnetic layer
40 . . . composite magnetic body
41 . . . soft magnetic metal particle
42 . . . ceramic particle
43 . . . binder
50 . . . coil conductor
5 . . . internal electrode layer
6 . . . led-out electrode
3 . . . terminal electrode

What is claimed is:

1. A composite magnetic body comprising:
soft magnetic metal particles; and
non-magnetic ceramic particles each having a particle size (D50) smaller than that of the soft magnetic metal particles, wherein
the non-magnetic ceramic particles comprise a silicate compound represented by a formula of $\alpha(\beta ZnO.(1-\beta)CuO).SiO_2$, where $\alpha$ is 1.5 to 2.4, and $\beta$ is 0.60 to 1.00.

2. The composite magnetic body according to claim 1, wherein an amount of the non-magnetic ceramic particles is 0.6 parts by weight or more and 90 parts by weight or less with respect to 100 parts by weight of the soft magnetic metal particles.

3. The composite magnetic body according to claim 1, wherein the non-magnetic ceramic particles have a circularity of less than 0.98.

4. The composite magnetic body according to claim 1, wherein the non-magnetic ceramic particles have a relative permittivity of 10 or less.

5. An electronic component comprising the composite magnetic body according to claim 1,
wherein the non-magnetic ceramic particles exist among the soft magnetic metal particles in a cross section of the composite magnetic body.

6. The electronic component according to claim 5, wherein $A_C/A_M$ is 0.07 to 19.3, where $A_M$ is an area occupied by the soft magnetic metal particles, and $A_C$ is an area other than the area occupied by the soft magnetic metal particles, in the cross section of the composite magnetic body.

* * * * *